US010689945B2

(12) United States Patent
Rogers

(10) Patent No.: US 10,689,945 B2
(45) Date of Patent: Jun. 23, 2020

(54) APPARATUS, METHOD AND SYSTEM FOR PLUGGING A WELL BORE

(71) Applicant: HALLIBURTON ENERGY SERVICES, INC., Houston, TX (US)

(72) Inventor: Henry Eugene Rogers, Oklahoma City, TX (US)

(73) Assignee: HALLIBURTON ENERGY SERVICES, Houston, TX (US)

( * ) Notice: Subject to any disclaimer, the term of this patent is extended or adjusted under 35 U.S.C. 154(b) by 99 days.

(21) Appl. No.: 16/061,053

(22) PCT Filed: Mar. 21, 2016

(86) PCT No.: PCT/US2016/023441

§ 371 (c)(1),
(2) Date: Jun. 11, 2018

(87) PCT Pub. No.: WO2017/164839

PCT Pub. Date: Sep. 28, 2017

(65) Prior Publication Data

US 2018/0363412 A1 Dec. 20, 2018

(51) Int. Cl.
*E21B 33/13* (2006.01)
*E21B 33/136* (2006.01)
(Continued)

(52) U.S. Cl.
CPC ..... *E21B 33/136* (2013.01); *E21B 33/1208* (2013.01); *E21B 33/13* (2013.01);
(Continued)

(58) Field of Classification Search
CPC .... E21B 33/136; E21B 33/1208; E21B 33/13; E21B 34/06; E21B 34/10; E21B 47/00; E21B 2034/007
See application file for complete search history.

(56) References Cited

U.S. PATENT DOCUMENTS 3,131,767 A * 5/1964 Chancellor ..... E21B 33/136 166/154
4,378,843 A * 4/1983 Suman, Jr. ..... E21B 33/127 166/187

(Continued)

FOREIGN PATENT DOCUMENTS

WO 2013033160 A1 3/2013

OTHER PUBLICATIONS

International Search Report and Written Opinion; PCT Application No. PCT/US2016/023441; dated Dec. 15, 2016.

*Primary Examiner* — Yong-Suk Ro
(74) *Attorney, Agent, or Firm* — Polsinelli PC

(57) ABSTRACT

Apparatuses, systems and methods for plugging a well bore. A plug formation apparatus includes a plug support tool having a substantially cylindrical and hollow body having one or more ports for fluid communication between an interior of the plug formation apparatus and an annulus of a well bore, a base extending radially around an outer surface of the body, and an elastically deformable member extending radially around an outer surface of the body beyond the base and supported by the base; a top-of-cement bypass sub having one or more ports, actuatable between a closed position and an open position; a detachment member coupled with the top-of-cement bypass sub; and a length of tubing fluidically coupled with an upper portion of the plug support tool and a lower portion of the top-of cement bypass sub.

27 Claims, 14 Drawing Sheets

(51) Int. Cl.

| | |
|---|---|
| ***E21B 33/12*** | (2006.01) |
| ***E21B 34/06*** | (2006.01) |
| ***E21B 34/10*** | (2006.01) |
| ***E21B 47/00*** | (2012.01) |
| *E21B 34/00* | (2006.01) |

(52) U.S. Cl.
CPC ..... *E21B 34/06* (2013.01); *E21B 34/10* (2013.01); *E21B 47/00* (2013.01); *E21B 2034/007* (2013.01)

(56) References Cited

U.S. PATENT DOCUMENTS

| | | | | |
|---|---|---|---|---|
| 4,407,369 | A * | 10/1983 | Hutchison | E21B 33/12 166/185 |
| 5,368,103 | A * | 11/1994 | Heathman | E21B 33/134 166/289 |
| 5,488,994 | A | 2/1996 | Laurel et al. | |
| 5,566,757 | A | 10/1996 | Carpenter et al. | |
| 5,718,292 | A | 2/1998 | Heathman et al. | |
| 6,772,835 | B2 | 8/2004 | Rogers et al. | |
| 6,973,966 | B2 | 12/2005 | Szarka | |
| 7,357,181 | B2 * | 4/2008 | Webb | E21B 21/10 166/177.4 |
| 8,739,873 | B2 | 6/2014 | Rogers et al. | |
| 9,422,787 | B2 * | 8/2016 | Fraser | E21B 23/06 |
| 2007/0261850 | A1 | 11/2007 | Giroux et al. | |
| 2011/0108276 | A1 | 5/2011 | Spence et al. | |
| 2013/0213654 | A1 | 8/2013 | Dewey et al. | |
| 2013/0312963 | A1 | 11/2013 | Larsen et al. | |

* cited by examiner

APPARATUS, METHOD AND SYSTEM FOR PLUGGING A WELL BORE

CROSS-REFERENCE TO RELATED APPLICATIONS

This application is a national stage entry of PCT/US2016/023441 filed Mar. 21, 2016, said application is expressly incorporated herein in its entirety.

FIELD

The present disclosure relates to an apparatus, method and system for plugging a well bore. More particularly, the present disclosure relates to a plug formation apparatus configured to couple with a work string and having a plug support tool, which includes a base and elastically deformable member, for supporting a slurry composition circulated thereon which subsequently forms a well bore plug.

BACKGROUND

When drilling a well bore which penetrates one or more subterranean earth formations, it is sometime advantageous or necessary to create a hardened plug in the well bore. Such plugs can be used for abandonment of the well, isolation of particular zones of the well bore, enhancement of well bore stability, to place a whipstock or sidetrack for creation of a new well bore which deviates from the original well bore, or kick-off procedures.

Typically, a cement or polymer-based plug can be set in a well bore by pumping a volume of spacer fluid compatible with drilling mud and cement slurry into the work string. Then a pre-determined volume of a cement or polymer containing slurry is pumped behind the spacer fluid. The slurry travels down the work string and exits through one or more openings located at the end of the work string. In this context, the end of the work string is usually referred to as the "tail pipe." Drilling fluid is usually pumped behind the slurry to maintain pressure within the work string.

At this point, the work string is raised within the well bore to permit the entire volume of slurry inside the conduit to flow out of the bottom of the tail pipe. However, the tail pipe must be raised very slowly or the slurry and the drilling fluid will mix, which may destroy the integrity of the plug. The process of raising the tail pipe generally causes damage to the plug because, as the tail pipe is raised, the drilling fluid in the work string mixes with the slurry.

BRIEF DESCRIPTION OF THE DRAWINGS

Implementations of the present technology will now be described, by way of example only, with reference to the attached figures, wherein.

Figure 1:
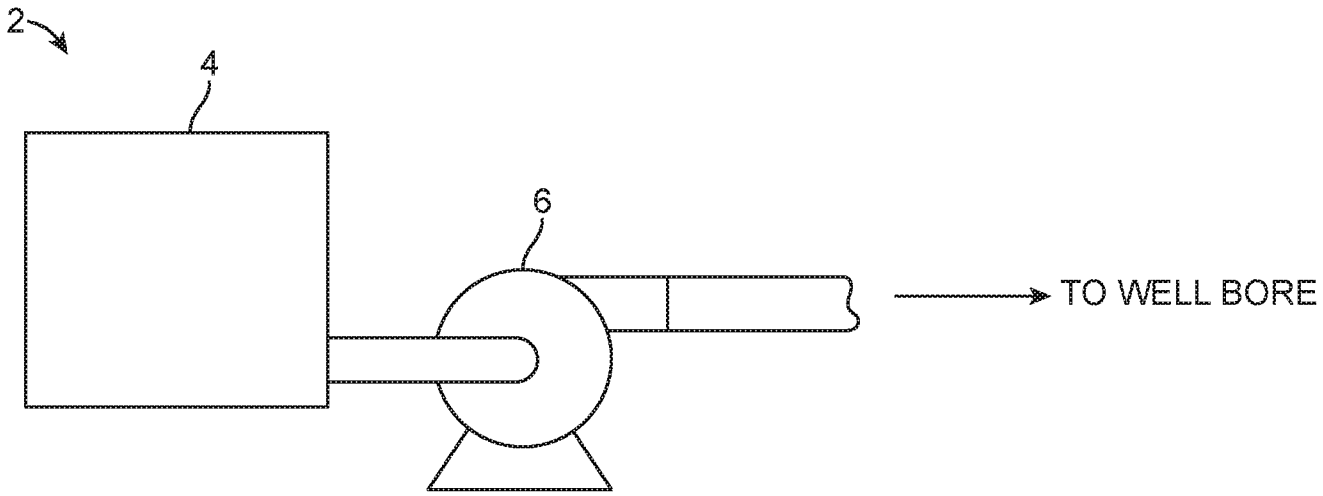
FIG. 1 is a system for preparation and delivery of a cement composition to a well bore in accordance with an exemplary embodiment of the present disclosure.

It should be understood that the various aspects are not limited to the arrangements and instrumentality shown in the drawings.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated, or certain components or portions thereof omitted, to better illustrate details and features of the present disclosure.

In the following description, terms such as "upper," "upward," "uphole," "lower," "downward," "above," "below," "downhole," "longitudinal," "lateral," and the like, as used herein, shall mean in relation to the bottom or furthest extent of, the surrounding well bore even though the well bore or portions of it may be deviated or horizontal. Correspondingly, the transverse, axial, lateral, longitudinal, radial, etc., orientations shall mean orientations relative to the orientation of the well bore or apparatus. Additionally, the illustrated embodiments are illustrated such that the orientation is such that the right-hand side or bottom of the page is downhole compared to the left-hand side, and the top of the page is toward the surface, and the lower side of the page is downhole. Furthermore, the term "proximal" refers directionally to portions further toward the surface in relation to the term "distal" which refers directionally to portions further downhole and away from the surface in a well bore.

Several definitions that apply throughout this disclosure will now be presented. The term "coupled" is defined as connected, whether directly or indirectly through intervening components, and is not necessarily limited to physical connections. The term "communicatively coupled" is defined as connected, either directly or indirectly through intervening components, and the connections are not necessarily limited to physical connections, but are connections that accommodate the transfer of data between the so-described components. The term "fluidically coupled" is defined as connected, either directly or indirectly through intervening components, to accommodate the transfer of liquids, slurries, mixtures, or other similar fluids between the so-described components. The connections can be such that the objects are permanently connected or releasably connected. The term "outside" refers to a region that is beyond the outermost confines of a physical object. The term "axially" means substantially along a direction of the axis of the object. If not specified, the term axially is such that it refers to the longer axis of the object. The terms "comprising," "including" and "having" are used interchangeably in this disclosure. The terms "comprising," "including" and "having" mean to include, but are not necessarily limited to, the things so described. A "processor" as used herein is an electronic circuit that can make determinations based upon inputs. A processor can include a microprocessor, a microcontroller, and/or a central processing unit, among others. While a single processor can be used, the present disclosure can be implemented using a plurality of processors.

The present disclosure is directed to a plug formation apparatus which includes a plug support tool. The plug support tool is located on the tail end, or most downhole portion, of the plug formation apparatus. The plug formation apparatus is transmitted downhole in a well bore with a work string with which it is coupled. The plug support tool includes a support base, an elastically deformable member and a one or more ports though which a cement or polymer slurry can flow out of the plug formation apparatus and into an annulus of the well bore to form a hardened plug. The elastically deformable member is configured to engage an inner surface of the well bore, separating the well bore into two portions, a portion above and a portion below the elastically deformable member. The weight of the slurry and/or hardened plug is directly supported by the elastically deformable member and support base of the plug support tool. The weight of the plug formation apparatus is supported by the work string and ground surface components of the cementing operation. The plug formation apparatus further includes a top-of-cement (TOC) bypass sub located uphole relative to the plug support tool and coupled therewith using a length of tubing. The TOC bypass sub can be used to inject a second cement or polymer slurry to form a second hardened plug on top of the first hardened plug.

The plug support tool, and the plug formation apparatus are further configured to bear the weight of the first and second hardened plugs. The plug formation apparatus further include a detachment member located uphole relative to the TOC bypass sub and coupled therewith using a length of tubing. The detachment member is also coupled with the work string and configured to decouple the plug formation apparatus from the work string upon successful placement of the hardened plugs. The integrity of the hardened plug(s) can be tested by applying an over-pull test and/or monitoring hook load of the apparatus during a plug formation process prior to decoupling.

Referring now to FIG. 1, a system that may be used in the preparation of a cement composition in accordance with example embodiments will now be described. FIG. 1 illustrates a system 2 for preparation of a cement composition and delivery to a well bore in accordance with certain embodiments. As shown, the cement composition can be mixed in mixing equipment 4, such as a jet mixer, recirculating mixer, or a batch mixer, for example, and then pumped via pumping equipment 6 to the well bore. In some embodiments, the mixing equipment 4 and the pumping equipment 6 can be disposed on one or more cement trucks as will be apparent to those of ordinary skill in the art. In some embodiments, a jet mixer can be used, for example, to continuously mix the composition, including water, as it is being pumped to the well bore.

Figure 2:
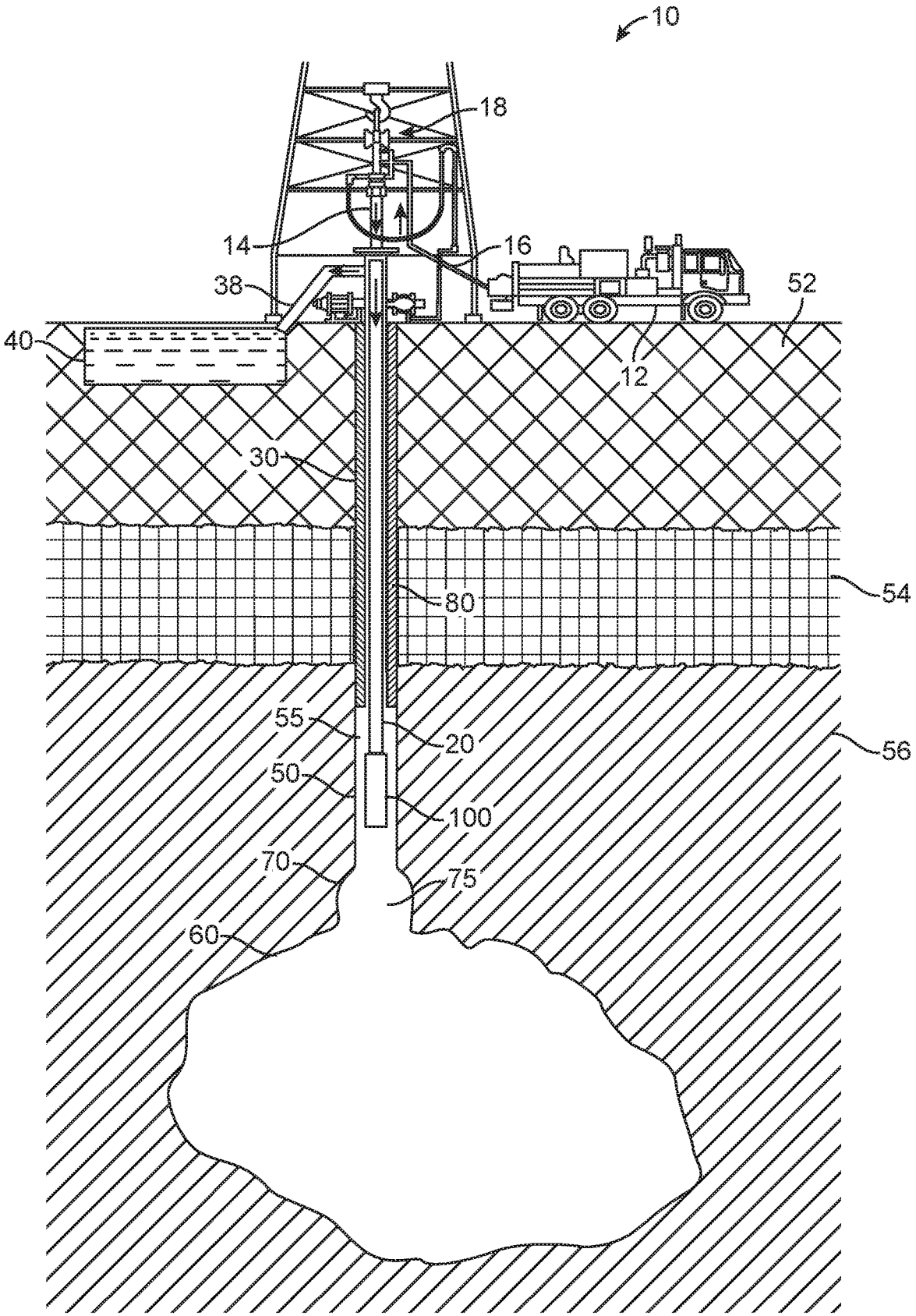
FIG. 2 is an overview diagram of the equipment for use in placement of a plug formation apparatus downhole in a well bore in accordance with an exemplary embodiment of the present disclosure.

FIG. 2 illustrates surface equipment 10 that can be used in placement of a cement composition in accordance with certain embodiments. As illustrated by FIG. 2, the surface equipment 10 can include a cementing unit 12, which can include one or more cement trucks. The cementing unit 12 can include mixing equipment 4 and pumping equipment 6 (e.g., FIG. 1) as will be apparent to those of ordinary skill in the art. The cementing unit 12 can pump a cement composition or slurry 14 through a feed pipe 16 and to a cementing head 18 which conveys the cement composition or slurry 14 downhole through a work string 20 to a plug formation apparatus 100. Also shown in FIG. 2 is a vertical well bore 30 having a casing 80 along a portion of the well bore 30. The well bore 30 has a first length 50 with an annulus 55 and second length 70 with an annulus 75. The diameter of the annulus 55 is less than the diameter of the annulus 75. The well bore 30 travels through strata 52, 54, 56 and penetrates an empty subterranean pocket 60. The empty subterranean pocket 60 can be formed from a salt deposit after removal of the salt from the pocket 60. In many instances, during removal of the salt from the pocket 60 a portion of the well bore 30 can become enlarged to form an expanded well bore length 70 having a diameter larger than the diameter of the well bore length 50. The surface equipment 10 can further include a flow line 38 for displaced fluids, such as drilling fluids and or spacer fluids to exit the well bore 30. The displaced fluids can be deposited in one or more retention pits 40 (for example, a mud pit).

One of ordinary skill will appreciate that, while FIG. 2 depicts an onshore operation, the present disclosure is equally well-suited for use in offshore operations. Additionally, while FIG. 2 depicts a vertical well bore having an upper portion with a first bore diameter and a lower portion with a second bore diameter larger than the first bore diameter, the present disclosure is equally well-suited for use deviated well bores and/or well bores having a uniform or substantially uniform bore diameter. Furthermore, while FIG. 2 depicts a well bore penetrating a subterranean formation containing a salt deposit, the present disclosure is equally suited to well bores penetrating subterranean formations containing hydrocarbon deposits, gaseous deposits, or any other deposit of interest.

Figure 3:
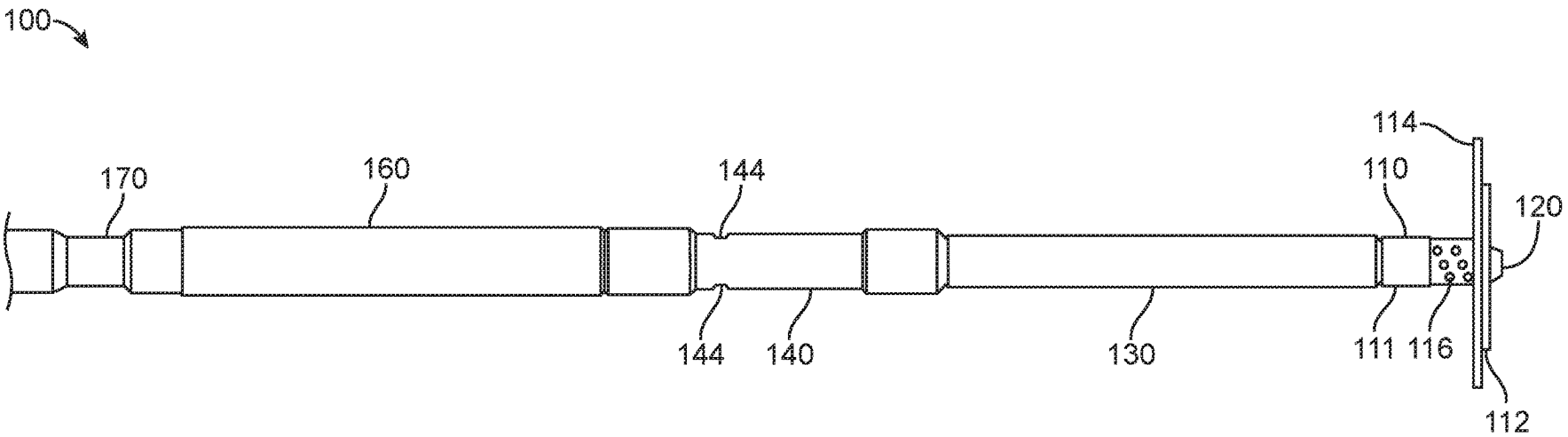
FIG. 3 is a side plan view of a plug formation apparatus in accordance with an exemplary embodiment of the present disclosure.

FIG. 3 is a side plan view of a plug formation apparatus 100 in accordance with an exemplary embodiment of the present disclosure. The plug formation apparatus 100 includes a plug support tool 110, and top-of-cement (TOC) bypass sub 140 and a detachment member 170. The detachment member 170 is fluidically coupled with the work string 20 (FIG. 2) for transmission of the plug formation apparatus 100 downhole in the well bore 30. The TOC bypass sub 140 is fluidically coupled with the plug support tool 110 via a length of tubing 130 and is fluidically coupled with the detachment member 170 via a length of tubing 160. The TOC bypass sub 140 includes one or more ports 144, actuatable between a closed position and an open position, for fluid communication between an interior of the plug formation apparatus 100 and the annuluses 55, 75.

In some instances the detachment member 170 is a bottom-hole kickoff assembly (BHKA) tool system or a BHKA disconnect tool. In other instances, the detachment member 170 can be, for example, a BHKA-disconnect torque-capable assembly, a tubing release tool (TRT), a hydraulic tubing release tool (HTRT), a BACE™ Buoyancy Assisted Casing Equipment Assembly, a dual-actuated circulating valve, a stinger assembly, a recirculatable ball-drop release device, a shear release joint, or any other suitable detachment mechanism.

The tubing 130 can be a single piece of tubing of any desired length or can be a plurality of pieces of tubing fluidically coupled with each other to form a tubing of any desired length. The tubing 160 can also be a single piece of tubing of any desired length or can be a plurality of pieces of tubing fluidically coupled with each other to form a tubing of any desired length. The tubings 130, 160 can be coupled with other components of the plug formation apparatus 100 (that is, the plug support tool 110, the TOC bypass sub 140, and the detachment member 170) by, for example, male and female threaded couplings wherein the tubings 130, 160 have a male threaded portion on each end thereof, a female threaded portion on each end thereof, a male threaded portion on one end and a female thread portion of the other end, a fully male or fully female threaded adapter that couples with the opposite located in a tubing 130, 160 and the opposite in an adjacent component of the plug formation apparatus 100, snap-lock or quick-connect couplings, spin lock collars, or any other suitable coupling mechanism.

The plug support tool 110 includes substantially cylindrical and hollow body 111 having a one or more ports 116 for fluid communication between the interior of the plug formation apparatus 100 and an annulus 55, 75 of the well bore 30. Cement or polymer slurry can be transmitted to the plug support tool 110 through the work string 20 and uphole components of the plug formation apparatus 110 and exits through the one or more ports 116 into the annulus 55, 75 to subsequently harden to form a plug. The plug support tool 110 also includes an aperture 120 for fluid communication between the plug formation apparatus 100 and portions of the well bore 30 downhole relative to the plug formation apparatus 100. The plug support tool 110 further includes a base support 112 extending radially around an outer surface of the body 111 and an elastically deformable member 114 extending radially around an outer surface of the body 111 and beyond the base support 112. The plug support tool 110 is supported by the base support 112. The plug support tool 110 is supported by the uphole components of the plug formation apparatus 100 and the plug formation apparatus is supported by the surface equipment 10 via the work string 20.

With regard to FIG. 3, in some instances, the aperture 120 may be omitted such that the most downhole portion of the plug support tool 110 has a solid bottom. In other instances the aperture 120 can be threaded or otherwise configured to engage a cap (not shown) which can stop fluid flow in and out of the aperture 120. In yet other instances, the aperture 120 can be substituted or coupled with a one way check valve assembly (not shown) wherein fluid can flow uphole into the plug formation apparatus 100 but not downhole into a region below the plug formation apparatus 100.

Figure 4:
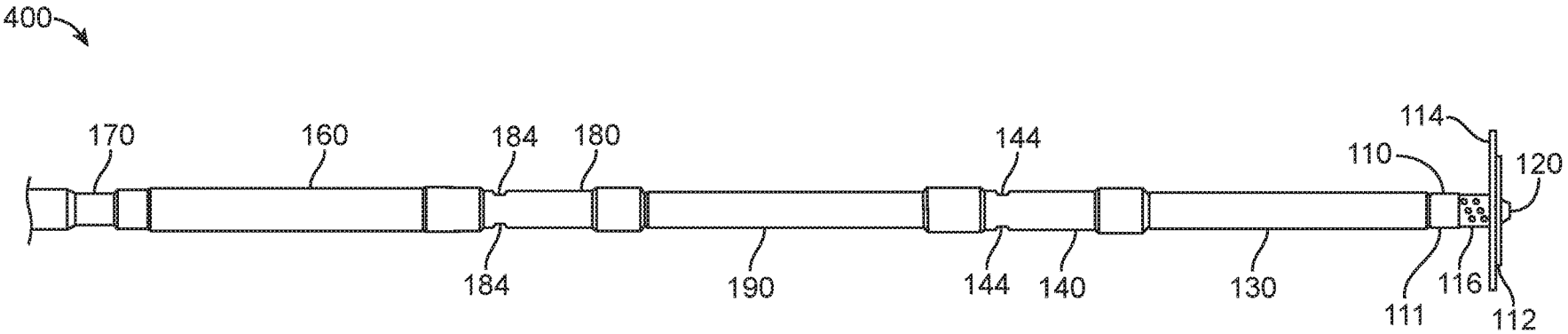
FIG. 4 is a side plan view of an alternative plug formation apparatus in accordance with an exemplary embodiment of the present disclosure.

FIG. 4 is a diagram of an alternative plug formation apparatus in accordance with an exemplary embodiment of the present disclosure. The plug formation apparatus 400 contains all of the components of the plug formation apparatus 100 and further includes an additional TOC bypass sub 180 having one or more ports 184, actuatable between a closed position and an open position, for fluid communication between an interior of the plug formation apparatus 400 and annuluses 55, 75. In FIG. 4, the TOC bypass sub 180 is fluidically coupled with the TOC bypass sub 140 via a length of tubing 190 and is fluidically coupled with the detachment member 170 via the length of tubing 160. The tubing 190 can be a single piece of tubing of any desired length or can be a plurality of pieces of tubing fluidically coupled with each other to form a tubing of any desired length. In alternative embodiments, one or more additional TOC bypass subs can be incorporated into the plug formation apparatus 400 and fluidically coupled with the components (that is, detachment member 170, plug support tool 110 and/or adjacent TOC bypass subs) of plug formation apparatus 400 via one or more lengths of tubing.

Also with regard to FIG. 4, in some instances, the aperture 120 may be omitted such that the most downhole portion of the plug support tool 110 has a solid bottom. In other instances the aperture 120 can be threaded or otherwise configured to engage a cap (not shown) which can stop fluid flow in and out of the aperture 120. In yet other instances, the aperture 120 can be substituted or coupled with a one way check valve assembly (not shown) wherein fluid can flow uphole into the plug formation apparatus 100 but not downhole into a region below the plug formation apparatus 100.

The plug formation apparatus 100, 400 and the work string 20 to which it is attached are configured to support the weight of one or more columns of cement slurry or other plug forming material during a cementing procedure. To that extent, the portions of the plug formation apparatus 100 that directly support the weight of the cement slurry or other plug forming material is the plug support tool 110, more specifically the elastically deformable member 114 and the base support 112. The base support 112 should extend radially as far as practicable without contacting the smallest diameter portion(s) of well bore 30 to provide the largest possible weight bearing surface area to support the elastically deformable member 114. For example, a well bore which has a 20 inch internal diameter at its smallest internal diameter would result in the use of a plug support tool 110 having a base support 112 of less than 20 inches. In such instances, the base support 112 can have a diameter ranging from 15 to 19.9 inches, alternatively 16 to 19.6 inches, alternatively 17 to 19.2 inches, and alternatively 18 to 19 inches.

In FIGS. 3-4, the elastically deformable member 114 is shown a single sheet of an elastically deformable material. In some instances the single sheet can have a uniform thickness of ⅛ to ½ of an inch. Alternatively, the single sheet can have a uniform thickness of ⅐ to ⅜ of an inch, alternatively ⅙ to ⅓ of an inch, and alternatively ⅕ to ¼ of an inch. In some instances, the single sheet of the elastically deformable material can have a thickness that gradually increases or gradually decreases radially outward. Furthermore, the elastically deformable material can be, for example, a natural or synthetic rubber, a fluoropolymer, a polyolefin, a polyacrylonitrile, an aromatic polyamide, a nylon, a polyester, a polyester-polyurethane copolymer, a polyvinyl chloride, a polyvinyl alcohol, a polyacrylate, or any combination thereof. The sheet of elastically deformable material can further include a layer of a structural support such as, for example, a mesh of metal or metal alloy, fiberglass, woven fiber mesh material, or any other similar material. In some instances, the sheet of elastically deformable material can have an alternative structural support being one or more flexible rods or "fingers" extending radially from the body 111.

In some instances, the elastically deformable member 114 can be made of two or more single sheets of an elastically deformable material fully or partially overlaid onto each other. Each sheet can have a uniform thickness of 1/16 to 1/3 of an inch. Alternatively, the each sheet can have a uniform thickness of 1/12 to 1/4 of an inch, alternatively 1/10 to 1/5 of an inch, and alternatively 1/8 to 1/6 of an inch. In other instances, each sheet of the elastically deformable material can have a thickness that gradually increases or gradually decreases radially outward.

Figure 5:
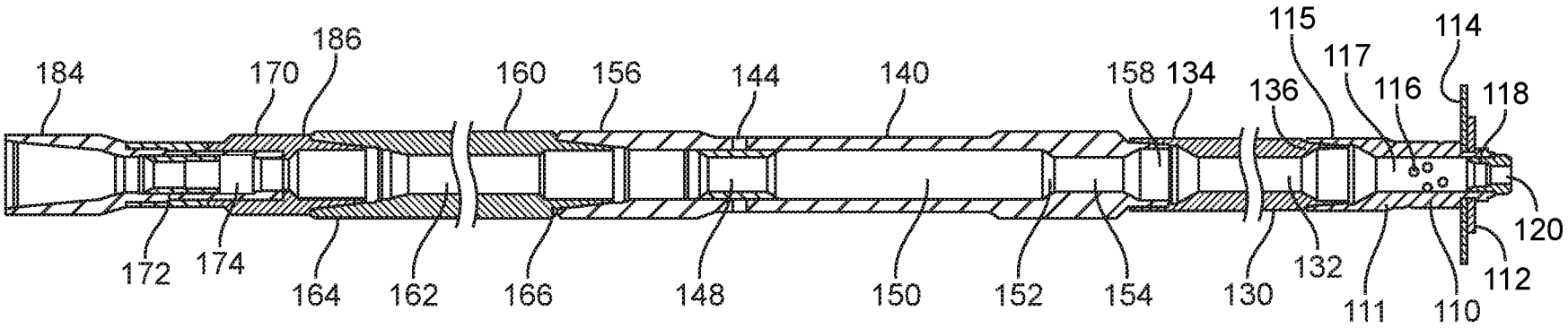
FIG. 5 is a cross-sectional view of the plug formation apparatus of FIG. 3 in accordance with an exemplary embodiment of the present disclosure.
Figure 6:
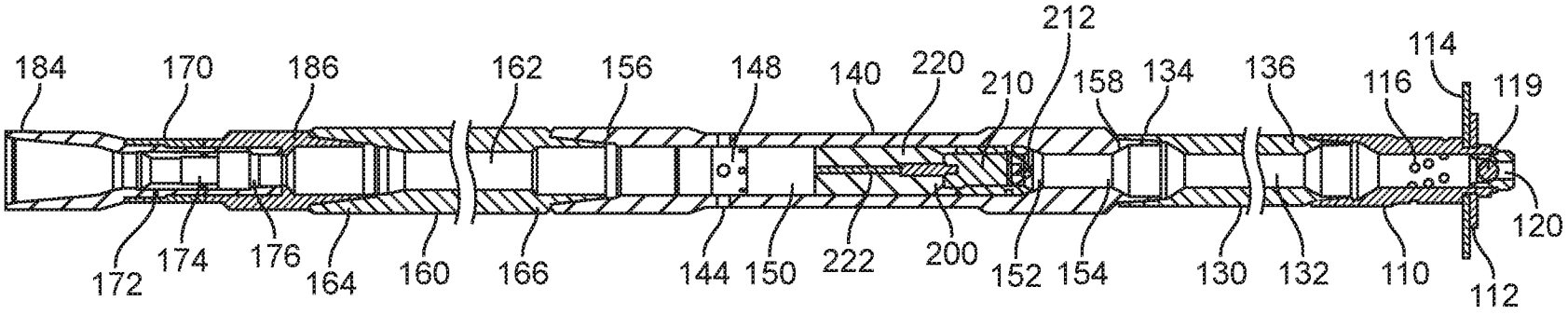
FIG. 6 is another cross-sectional view of the plug formation apparatus of FIG. 3 with additional components in accordance with an exemplary embodiment of the present disclosure.

FIG. 5 is a cross-sectional view of the plug formation apparatus 100 in accordance with an exemplary embodiment of the present disclosure. FIG. 6 is another cross-sectional view of the plug formation apparatus 100 with additional components in accordance with an exemplary embodiment of the present disclosure. As described above, the plug support tool 110 has a substantially cylindrical body 111, a base support 112, an elastically deformable member 114 and an aperture 120 for fluid communication between the plug formation apparatus 100 and portions of the well bore 30 downhole relative to the plug formation apparatus 100.

The plug support tool 110 further comprises a longitudinal fluid passageway 117 and a one or more ports 116 for fluid communication between the annuluses 55, 75 of the well bore lengths 50, 70 and the plug formation apparatus 100. The fluid passageway 117 further includes a restricted fluid passageway portion 118 which has a smaller internal diameter than that of the fluid passageway 117. Fluid flow through the aperture 120 can be stopped using a diverter tool 119 which is transmitted to the aperture 120 through the work string 20 and uphole components of the plug formation apparatus 100. The diverter tool 119 has a diameter larger than that of the aperture 120 and rests in the restricted fluid passageway portion 118. The diverter tool 119 is shown in FIG. 6 as a ball. In some instances, the diverter tool 119 can be a dart, a tubular member ending in a conical, frustoconical or otherwise tapered downhole tip. The diverter tool 119 can be made of soft and/or absorbent material that wipes and/or cleans the inner surface of the work string 20 and uphole components of the plug formation apparatus 100 as it proceeds downhole. In some instances the diverter tool 119 can be made of, for example, a sponge-like material having an impermeable uphole-facing cap. The plug support tool 110 also has a female coupling mechanism 115 for coupling with a male coupling mechanism 136 of the tubing 130. The tubing 130 further includes a longitudinal fluid passageway 132 for fluid communication with the TOC bypass sub 140 and the plug support tool 110. The tubing 130 further includes a female coupling mechanism 134 for coupling with a male coupling mechanism 158 of the TOC bypass sub 140.

The TOC bypass sub 140 has a main longitudinal fluid passageway 150, a minor fluid passageway 154 and a restricted passageway portion 152 therebetween. The TOC bypass sub 140 further includes a pressure sensitive member 148 which is configured for longitudinal movement within the main fluid passageway 150 to open and close the one or more ports 144 for fluid communication between the main fluid passageway 150 and annuluses 55, 75 of the well bore lengths 50, 70. The restricted fluid passageway portion 152 has a smaller internal diameter than that of the main fluid passageway 150. Fluid flow through the TOC bypass sub 140 to downhole components of the plug formation apparatus 100 can be stopped using a diverter tool 200 which is transmitted to the restricted fluid passageway portion 152 through the work string 20 and uphole components of the plug formation apparatus 100. The diverter tool 200 has a diameter larger than that of the restricted fluid passageway portion 152 and rests therein. The diverter tool 200 is shown in FIG. 6 as a dart having a tubular member 210 ending in a conical, frustoconical or otherwise tapered downhole tip 212. The diverter tool 200 further includes a body 220 and a mandrel 222 located through a longitudinal center portion thereof. The mandrel 222 can be constructed of any suitable material such as, for example, plastics, phenolics, composite materials, high strength thermoplastics, glass, metals, or metal alloys. The body 220 can be made of a foam or foam-like material such as, for example, open-cell foams comprising natural rubber, nitrile rubber, styrene butadiene rubber, polyurethane, or any other similar material. The body 220 can be used to wipe and/or clean the inner surface of the work string 20 and components of the plug formation apparatus 100 as is proceeds downhole to the restricted fluid passageway portion 152. The TOC bypass sub 140 further includes a female coupling mechanism 156 for coupling with a male coupling mechanism 166 of the tubing 160. The tubing 160 includes a longitudinal fluid passageway 162 for fluid communication with the detachment member 170 and the TOC bypass sub 140. The tubing 160 further includes a female coupling mechanism 164 for coupling with a male coupling mechanism 186 of the detachment member 170.

The detachment member 170 further includes a detachment assembly 172 and a female coupling mechanism 184 for coupling with the work string 20. The detachment member 170 has a longitudinal variable diameter fluid passageway 174, which includes a restricted fluid passageway portion 176, for fluid communication between the work string 20 and the other components of the plug formation apparatus 100.

In general, restricted fluid passageways 176, 152 and 118 should decrease in diameter in that order to accommodate correct placement of the diverter tools 119 and 200 respectively in the plug formation apparatus 100.

While FIGS. 3-6 depict a plug formation apparatus 100 having the detachment member 170 and the TOC bypass sub 140 coupled with each other via the tubing 160, one of ordinary skill in the art will appreciate that, in some instances, the tubing 1760 can be omitted and the detachment member 170 and the TOC bypass sub 140 can be directly coupled to each other.

Figure 7:
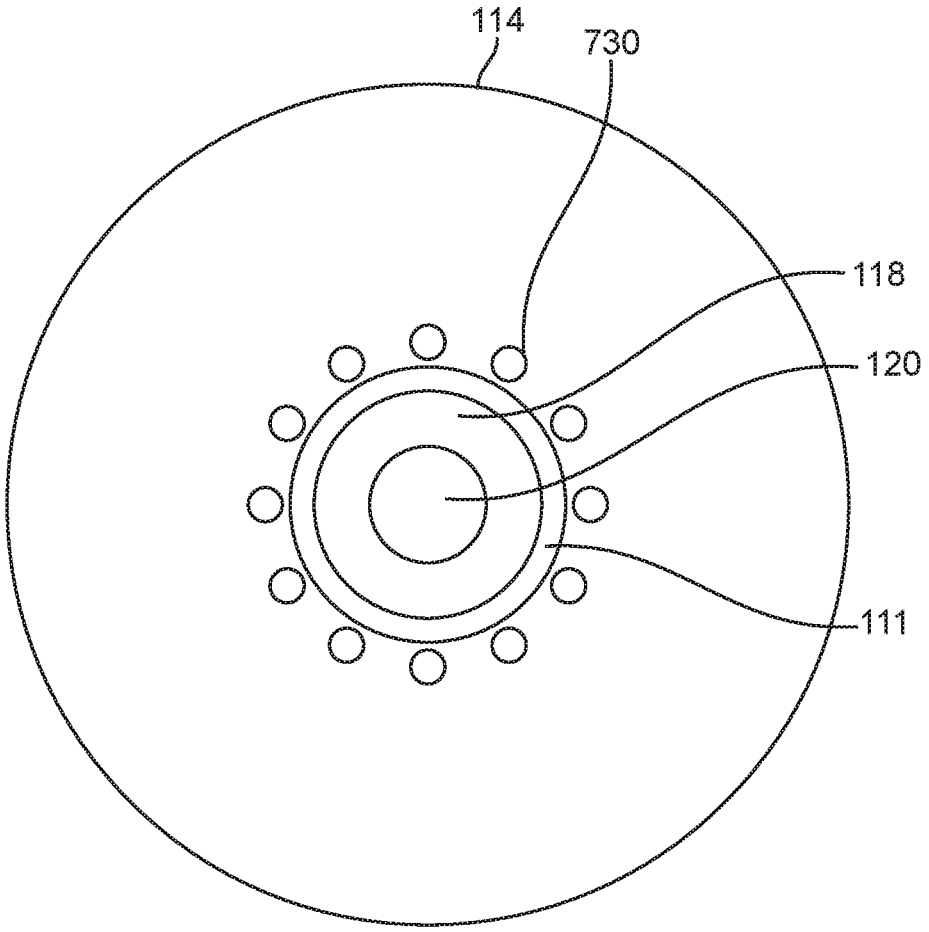
FIG. 7 is a top plan view of a plug support tool in accordance with an exemplary embodiment of the present disclosure.
Figure 8:
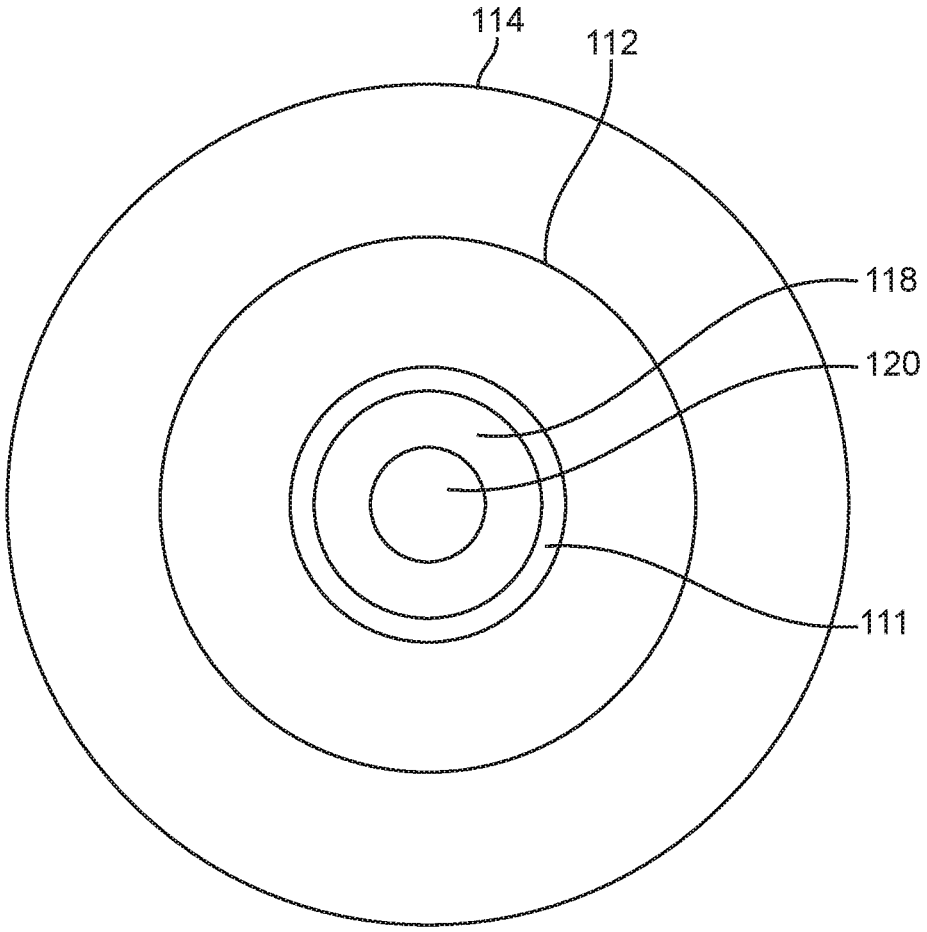
FIG. 8 is a bottom plan view of the plug support tool of FIG. 7 in accordance with an exemplary embodiment of the present disclosure.

FIG. 7 is a top plan view of the plug support tool 110 in accordance with an exemplary embodiment of the present disclosure. FIG. 8 is a bottom plan view of the plug support tool 110 in accordance with an exemplary embodiment of the present disclosure. As shown in FIGS. 7-8, the base support 112 extends radially around the body 111 of the plug support tool 110. The elastically deformable member 114 extends radially around an outer surface of the body 111 and beyond the base support 112. The elastically deformable member 114 can be coupled with the base support 112 by a plurality of rivets 730. In alternative embodiments, the rivets 730 can be in the form of screws threaded into the base support 112, nuts for threadedly engaging corresponding bolts immobilized on the base support 112, cotter pins for cooperatively engaging corresponding clevis pins immobilized on the base support 112, or any other suitable coupling mechanism. In other instances, the elastically deformable member 114 can be adhered to the base support 112 using one or more suitable adhesives. As shown, the plug support tool 110 further includes the restricted fluid passageway portion 118 and the aperture 120.

Figure 9:
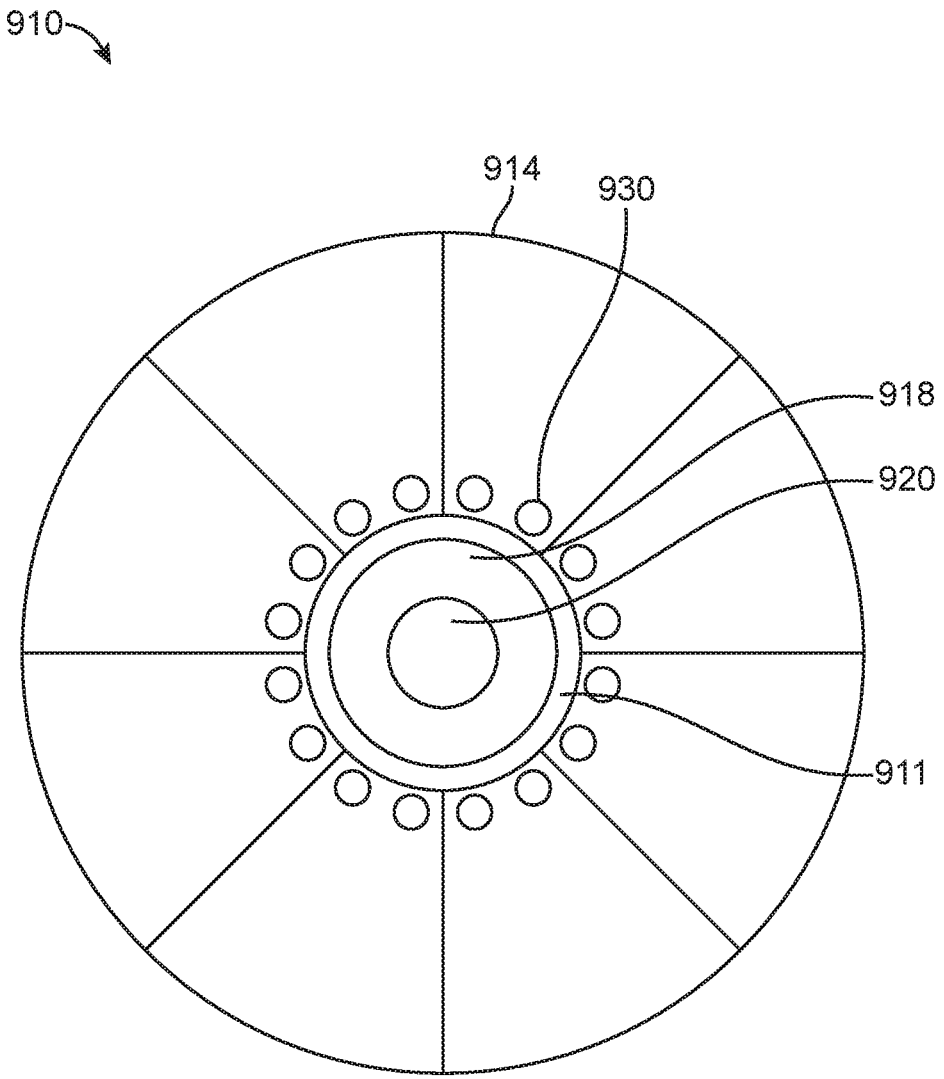
FIG. 9 is a top plan view of an alternative plug support tool in accordance with an exemplary embodiment of the present disclosure.
Figure 10:
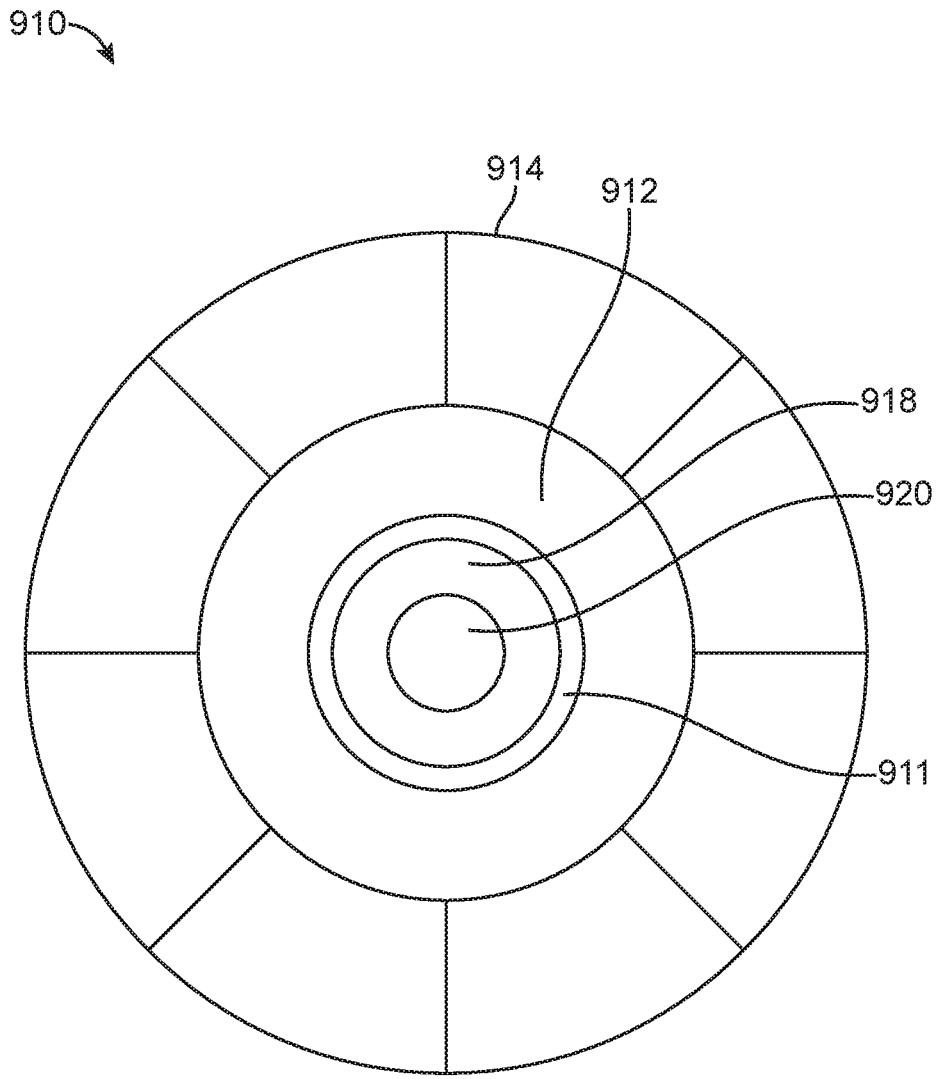
FIG. 10 is a bottom plan view of the plug support tool of FIG. 9 in accordance with an exemplary embodiment of the present disclosure.

FIG. 9 is a top plan view of an alternative plug support tool 910 in accordance with an exemplary embodiment of the present disclosure. FIG. 10 is a bottom plan view of the plug support tool 910 in accordance with an exemplary embodiment of the present disclosure. As shown in FIGS. 9-10, a base support 912 extends radially around a body 911 and aperture 920 of the plug support tool 910. A plurality of elastically deformable members 914 extend radially around an outer surface of the body 911 and beyond the base support 912. The plurality of elastically deformable members 914 are supported by the base support 912. Each of the plurality of elastically deformable members 914 partially overlap adjacent members 914. Each of the plurality of elastically deformable members 914 can be coupled with the base support 912 by a plurality of rivets 930. In alternative embodiments, the rivets 930 can be in the form of screws threaded into the base support 912, nuts for threadedly engaging corresponding bolts immobilized on the base support 912, cotter pins for cooperatively engaging corresponding clevis pins immobilized on the base support 112, or any other suitable coupling mechanism. In other instances, each of the elastically deformable members 914 can be adhered to the base support 912 using a suitable adhesive. As shown, the plug support tool 910 further includes a restricted fluid passageway portion 918 and an aperture 920 which are structurally and functionally similar to the restricted fluid passageway portion 118 and the aperture 120 respectively.

In FIGS. 9-10, each of the plurality of elastically deformable members 914 is a single sheet of an elastically deformable material. In some instances the single sheet can have a uniform thickness of ⅛ to ½ of an inch. Alternatively, the single sheet can have a uniform thickness of ⅐ to ⅜ of an inch, alternatively ⅙ to ⅓ of an inch, and alternatively ⅕ to ¼ of an inch. In some instances, the single sheet of the elastically deformable material can have a thickness that gradually increases or gradually decreases radially outward. Furthermore, the elastically deformable material can be, for example, a natural or synthetic rubber, a fluoropolymer, a polyolefin, a polyacrylonitrile, an aromatic polyamide, a nylon, a polyester, a polyester-polyurethane copolymer, a polyvinyl chloride, a polyvinyl alcohol, a polyacrylate, or any combination thereof. The sheet of elastically deformable material can further include a layer of a structural support such as, for example, a metal, fiberglass, or woven fiber mesh material. In some instances, the sheet of elastically deformable material can have an alternative structural support be one or more flexible rods or "fingers" extending radially from the body 911.

In some instances, each of the plurality of elastically deformable members 914 can be made of two or more single sheets of an elastically deformable material fully or partially overlaid onto each other. Each sheet of each of the plurality of elastically deformable members 914 can have a uniform thickness of 1/16 to ⅓ of an inch. Alternatively, each sheet can have a uniform thickness of 1/12 to ¼ of an inch, alternatively 1/10 to ⅕ of an inch, and alternatively ⅛ to ⅙ of an inch. In other instances, the each sheet of the elastically deformable material can have a thickness that gradually increases or gradually decreases radially outward.

Figure 11:
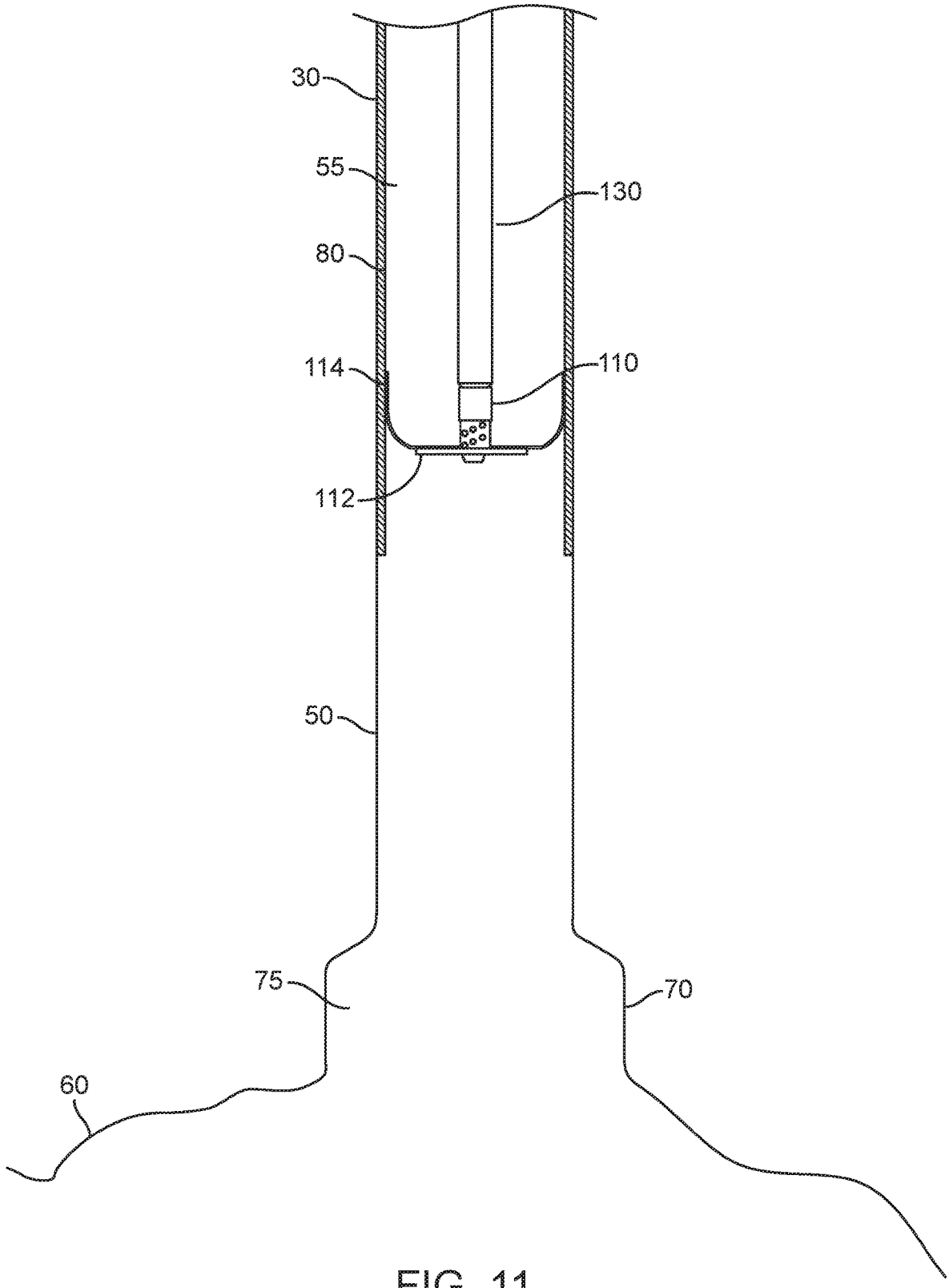
FIG. 11 is a diagram of a portion of the plug formation apparatus of FIG. 3 traversing a first portion of the well bore in accordance with an exemplary embodiment of the present disclosure.

FIG. 11 is a diagram of a portion of the plug formation apparatus 100 traversing a first portion of the well bore in accordance with an exemplary embodiment of the present disclosure. As shown, a portion of the plug formation apparatus 100 including the tubing 130 and the plug support tool 110 is located in a portion of the well bore 30 having the casing 80. The elastically deformable member 114 has an outer diameter which exceeds the inner diameter of the well bore length 50 and well bore length 70. The elastically deformable member slidingly engages the wall of the well bore 30 and casing 80 as it moves downhole to isolate the lengths of well bore 30 uphole and downhole relative to the plug support tool 110.

Figure 12:
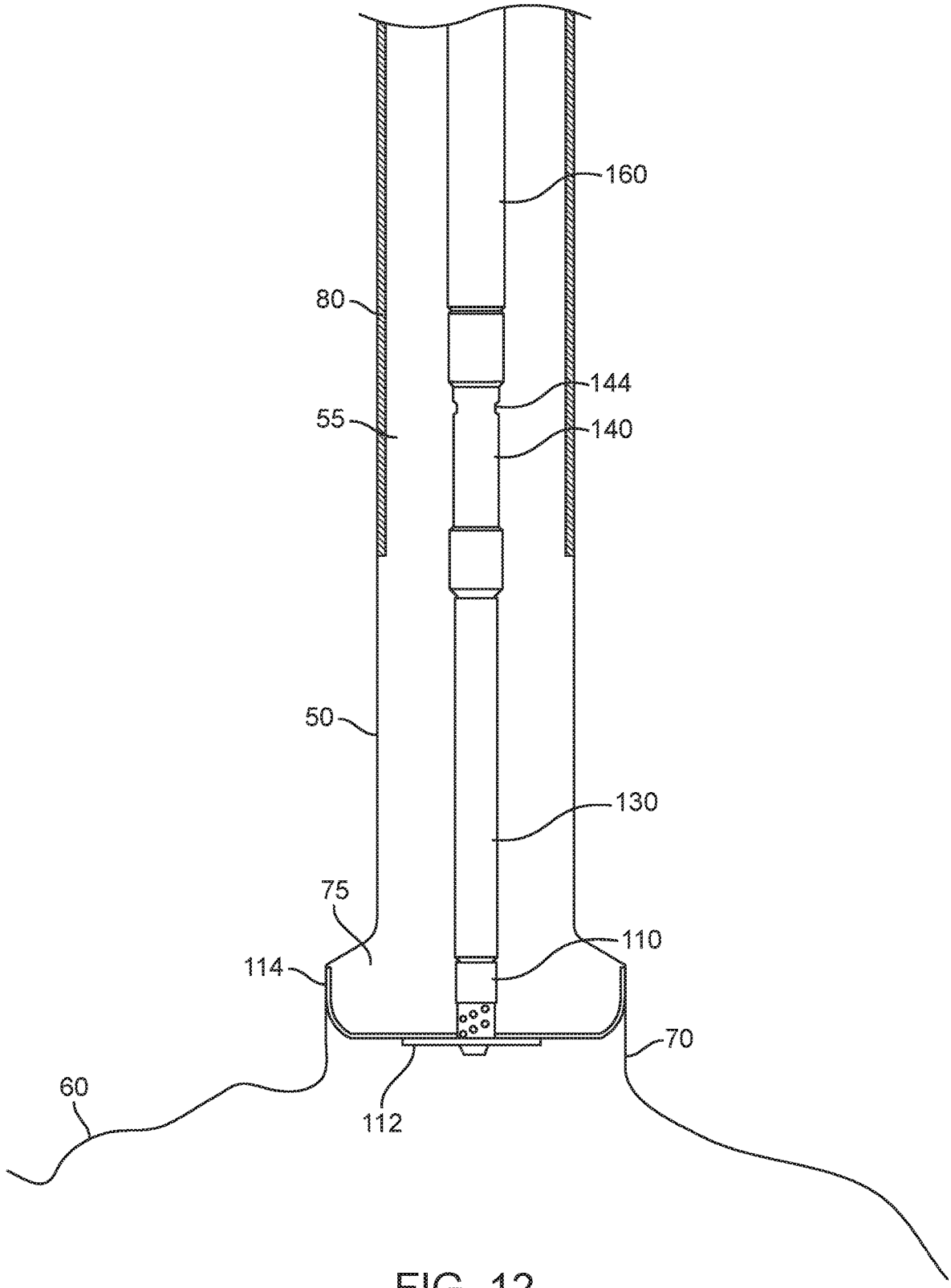
FIG. 12 is a diagram of a portion of the plug formation apparatus of FIG. 3 placed in a second portion of the well bore in accordance with an exemplary embodiment of the present disclosure.

FIG. 12 is a diagram of a portion of the plug formation apparatus 100 placed in the well bore length 70 of the well bore 30 in accordance with an exemplary embodiment of the present disclosure. As shown, the plug formation apparatus 100 is further run downhole to a location where the elastically deformable member 114 of the plug support tool 100 is slidingly engaged with the well bore length 70 to isolate the well bore length 50 and at least a portion of well bore length 70 from the subterranean pocket 60.

Figure 13:
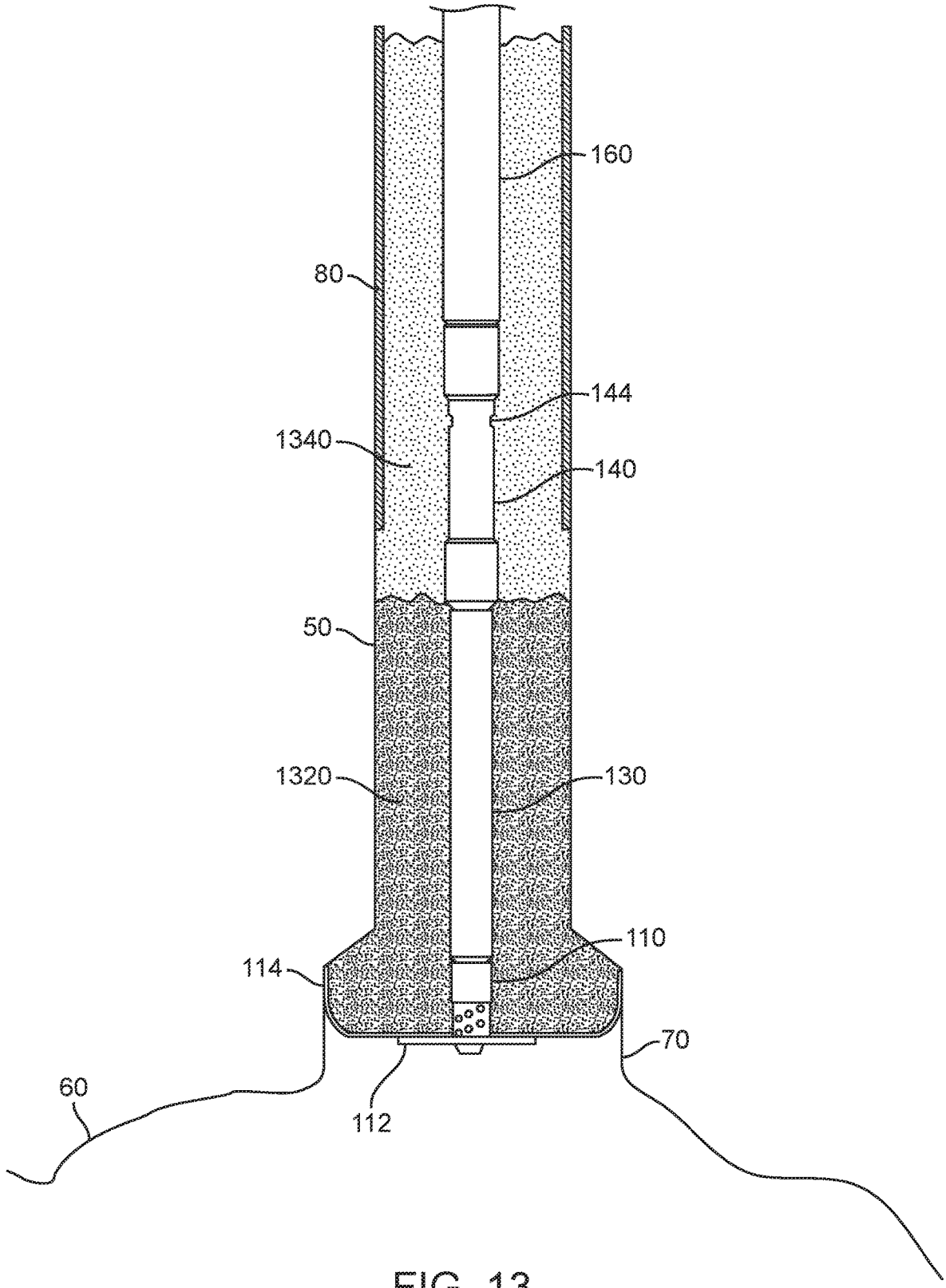
FIG. 13 is a diagram of a portion of the plug formation apparatus of FIG. 3 placed in a second portion of the well bore with a first cement composition and a second cement composition placed in the first and second portions of the well bore respectively in accordance with an exemplary embodiment of the present disclosure.

FIG. 13 is a diagram of a portion of the plug formation apparatus of 100 placed in the well bore length 70 of the well bore 30 with a first plug composition and a second plug composition placed in annuluses 55, 75 of the well bore lengths 50, 70 respectively in accordance with an exemplary embodiment of the present disclosure. As shown, a first plug composition 1320 is located above the elastically deformable member 114 and below the TOC bypass sub 140 and spans a portion of the well bore length 50 and a portion of the well bore length 70. A second plug composition 1340 is placed uphole relative to the first plug composition 1320. To place the first plug composition 1320 in the portion of well bore length 50 and portion of the well bore length 70, the diverter tool 119 is first transmitted through the work string 20 and plug formation apparatus 100 until it reaches and comes to rest in the restricted fluid passageway portion 118 to block fluid flow through the aperture 120. Then a cement or polymer slurry is injected downhole through the work string 20 and plug formation apparatus 100, and subsequently exits the plug support tool 110 through the one or more ports 116 and into the annuluses 55, 75. The cement or polymer slurry is injected until it reaches a bottom portion of the TOC bypass sub 140. In some instances, it may be desired to inject the cement or polymer slurry to a point above the bottom portion of the TOC bypass sub 140 to account for potential settling of the slurry or loss of slurry downhole through or around the plug support tool 110. Upon drying, the cement or polymer slurry forms first plug composition 1320.

The diverter tool 200 can then be transmitted through the work string 20 and portions of plug formation apparatus 100 until it reaches and comes to rest in the restricted passageway portion 152 to block fluid flow to downhole components of the plug formation apparatus 100. Upon blocking fluid flow through the restricted passageway portion 152, the TOC bypass sub 140 becomes pressurized and the increase in pressure the actuates pressure sensitive member 148 to move longitudinally within the main fluid passageway 150 to open and close the one or more ports 144 for fluid communication between the main fluid passageway 150 and annulus 55. A cement or polymer slurry is then injected downhole through the work string 20 and uphole components of the plug formation apparatus 100, and subsequently exits the TOC bypass sub 140 through the one or more ports 144 and into the annulus 55. The cement or polymer slurry is injected until it reaches pre-determined distance from the detachment member 170 such as, for example 25 to 200 feet downhole relative to the detachment member 170. Alternatively, cement or polymer slurry can injected until it reaches a point that is 30 to 150 feet downhole relative to the detachment member 170, alternatively 40 to 125 feet downhole relative to the detachment member 170, and alternatively 50 to 100 feet downhole relative to the detachment member 170. Upon drying, the cement or polymer slurry forms second plug composition 1340. The first plug composition 1320 and the second plug composition 1340 can be the same composition or a different composition.

Figure 14:
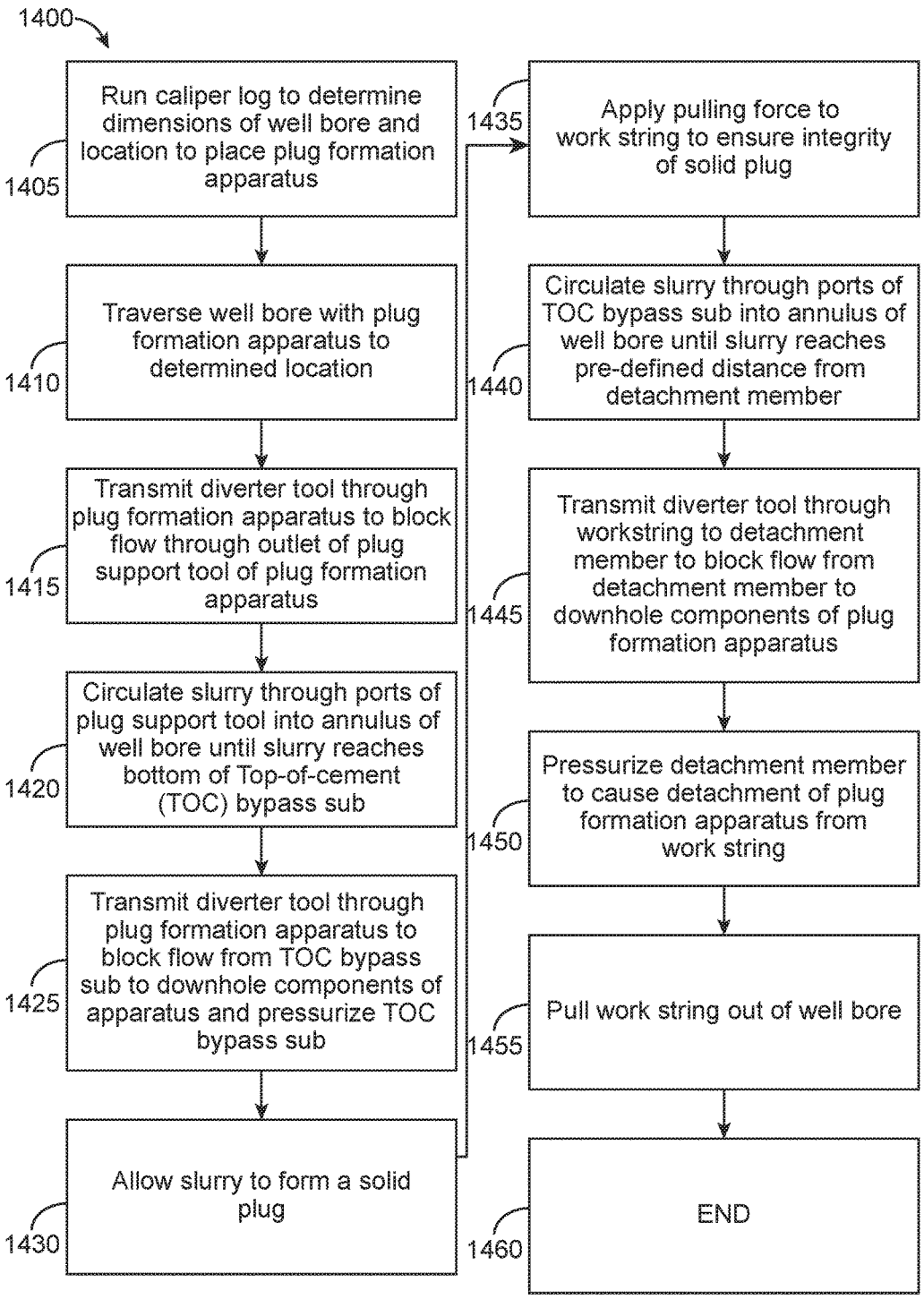
FIG. 14 is a diagram of a method of using a plug formation apparatus in accordance with an exemplary embodiment of the present disclosure.

FIG. 14 is a diagram of a method of using a plug formation apparatus in accordance with an exemplary embodiment of the present disclosure. The method 1400 is provided by way of example, as there are a variety of ways to carry out the method. The method 1400 described below can be carried out using the configurations illustrated in FIGS. 1-10, for example, and various elements of these figures are referenced in explaining example method 1400. Each block shown in FIG. 14 represents one or more processes, methods or subroutines, carried out in the example method 1400. Furthermore, the illustrated order of blocks is illustrative only and the order of the blocks can change according to the present disclosure. Additional blocks may be added or fewer blocks may be utilized, without departing from this disclosure. The example method 1400 can begin at block 1405.

At block 1405, a caliper log is obtained to determine the dimensions of a well bore from the surface of the well bore to a bottom of the well bore or to an empty subterranean pocket such as, for example, a pocket formed by evacuation of a previously existing salt or hydrocarbon bearing subterranean deposit. The obtained caliper log will be used to determine a placement depth of a plug formation apparatus and the corresponding dimensions of a plug support tool of the plug formation apparatus. Specifically, the appropriate diameter of an elastically deformable member and a support base of the plug support tool will be determined. Obtaining a caliper log can be performed by any suitable method as known to one of ordinary skill in the art and the method of obtaining a caliper log does not limit the present disclosure in any way.

At block 1410, the plug formation apparatus is coupled with a work string and traversed downhole into the well bore to the determined location. In some instances, the well bore will be found to have a substantially uniform well bore diameter. In other circumstances, the well bore will be found to have at least two distinct well bore lengths, a first well bore length running from the ground surface to a second well bore length having a diameter larger than the first well bore length. When there are two distinct well bore lengths, the plug formation apparatus will be placed in the lower, larger diameter, well bore length.

At block 1415, upon placement of the plug formation apparatus in the pre-determined well bore location, a diverter tool is transmitted through the work string and the plug formation apparatus until it reaches and comes to rest in a restricted fluid passageway of the plug support tool. Upon resting in the restricted fluid passageway of the plug support tool, fluid flow through the plug formation apparatus and out of a downhole aperture in the plug support tool is sealed and subsequent fluid flow will instead be redirected out of one or more ports located on a longitudinal surface of the plug support tool into an annulus of the well bore. In some instances, block 1415 may be omitted. For example, in some instances, the aperture may be omitted such that the most downhole portion of the plug support tool has a solid bottom obviating the need to inject a diverter tool to rest in the restricted fluid passageway of the plug support tool. In other instances the aperture can be threaded or otherwise configured to engage a cap (not shown), and the cap can stop fluid flow in and out of the aperture obviating the need to inject a diverter tool to rest in the restricted fluid passageway of the plug support tool. In yet other instances, the aperture can be substituted or coupled with a one way check valve assembly (not shown) wherein fluid can flow uphole into the plug formation apparatus but not downhole into a region below the plug formation apparatus obviating the need to inject a diverter tool to rest in the restricted fluid passageway of the plug support tool.

At block 1420, a cement or polymer slurry is transmitted downhole through the work string and the plug formation apparatus. The slurry is then circulated out of the plug support base into the well bore annulus until the slurry reaches a TOC bypass sub of the plug formation apparatus. In some instances slurry is circulated out of the plug support tool into the well bore annulus until the slurry reaches a point above the TOC bypass sub to account for potential settling of the slurry or loss of slurry downhole through or around the plug support base. The amount of weight being supported by the plug support tool, and the plug formation apparatus, is monitored by, for example, a hook load sensor which can be located uphole with the surface equipment and communicatively coupled with the work string. If the hook load sensor shows a decrease in load, a loss of slurry downhole through the plug support tool can be determined. If no loss of load is observed, the procedure can continue to block 1425. If a loss of load is observed, block 1420 is performed again or the process can be restarted at block 1410 in the event that the plug support tool has become compromised during block 1420 or any preceding block.

At block 1425, a second diverter tool is transmitted through the work string and portions of the plug formation apparatus until it reaches and comes to rest in a restricted fluid passageway of the TOC bypass sub. Upon resting in the restricted fluid passageway of the TOC bypass sub, fluid flow through the plug formation apparatus downhole relative to the TOC bypass sub is blocked. The TOC bypass sub is then pressured to, for example 1,000 to 1,500 psi. The increase in pressure actuates a pressure sensitive member which is configured for longitudinal movement within a main fluid passageway of the TOC bypass sub to open one or more ports on a longitudinal surface of the TOC bypass sub. Subsequent fluid flow will therefore be redirected out of the one or more ports the annulus of the well bore. The load on the plug formation apparatus can again be measured using hook load sensor to ensure that pressurization of the TOC bypass sub did not compromise the load bearing nature of the plug formation apparatus.

At block 1430, the slurry circulated in block 1420 is allowed to harden to form a first solid plug.

At block 1435, an over-pull test is applied to the work string and the plug formation apparatus to test the integrity of the plug. If the work string and plug formation apparatus does not move in response to the over-pull test, the process can proceed to block 1440. If the work string and plug formation apparatus does move in response to the over-pull test, the block 1430 of can be repeated.

At block 1440, a second cement or polymer slurry is transmitted downhole through the work string to the TOC bypass sub of the plug formation apparatus. The second cement or polymer slurry can be the same as, or different from, the first cement or polymer slurry. The slurry is then circulated out of the TOC bypass sub into the well bore annulus until the slurry reaches a pre-determined distance away from a detachment member which couples the work string with the downhole components of the plug formation apparatus. The cement or polymer slurry is injected until it reaches a pre-determined distance from the detachment member such as, for example 25 to 200 feet downhole relative to the detachment member. Alternatively, cement or polymer slurry can injected until it reaches a point that is 30 to 150 feet downhole relative to the detachment member, alternatively 40 to 125 feet downhole relative to the detachment member, and alternatively 50 to 100 feet downhole relative to the detachment member. The amount of weight being supported by the plug support tool, and the plug formation apparatus, can again be monitored by, for example, a hook load sensor which can be located uphole with the surface equipment and communicatively coupled with the work string. If the hook load sensor shows a decrease in load, a loss of slurry downhole through the plug support tool can be determined. If no loss of load is observed, the procedure can continue to block 1445. If a loss of load is observed, block 1440 is performed again or the process can be restarted at block 1410 in the event that the plug support tool has become compromised during block 1420 or any preceding block.

At block 1445, a third diverter tool is transmitted through the work string until it reaches and comes to rest in a restricted fluid passageway of the detachment member. Upon resting in the restricted fluid passageway of the detachment member, fluid flow through the plug formation apparatus downhole relative to the detachment member is blocked. The detachment member is then pressured to, for example 1,500 to 3,000 psi. The increase in pressure actuates a pressure sensitive member of the detachment member to initiate detachment of the work string from the plug formation apparatus.

In block 1455, the work string is pulled out of the well bore, leaving the plug formation apparatus downhole.

In block 1460, the second slurry is allowed to harden to form a second solid plug, and the process ends.

STATEMENTS OF THE DISCLOSURE INCLUDE

Statement 1: A plug formation apparatus comprising: a plug support tool having a substantially cylindrical and hollow body having one or more ports for fluid communication between an interior of the plug formation apparatus and an annulus of a well bore, a base extending radially around an outer surface of the body, and an elastically deformable member extending radially around an outer surface of the body beyond the base and supported by the base; a top-of-cement bypass sub having one or more ports, actuatable between a closed position and an open position; a detachment member coupled with the top-of-cement bypass sub; and a length of tubing fluidically coupled with an upper portion of the plug support tool and a lower portion of the top-of cement bypass sub.

Statement 2: An apparatus according to Statement 1, further comprising a second length of tubing fluidically coupled with an upper portion of the top-of cement bypass sub and a lower portion of the detachment member.

Statement 3: An apparatus according to any one of Statements 1-2, wherein the elastically deformable member comprises a plurality of partially overlapping plates.

Statement 4: An apparatus according to any one of Statements 1-3, wherein the detachment member is a bottom-hole kickoff assembly.

Statement 5: An apparatus according to any one of Statements 1-4, further comprising one or more additional top-of cement bypass subs, the one or more additional top-of-cement bypass subs coupled with the upper portion of the top-of-cement bypass sub and the lower portion of the detachment member via one or more lengths of tubing.

Statement 6: An apparatus according to any one of Statements 1-5, wherein the elastically deformable member comprises a rubber, a fluoropolymer, a polyolefin, a polyacrylonitrile, an aromatic polyamide, a nylon, a polyester, a polyester-polyurethane copolymer, a polyvinyl chloride, a polyvinyl alcohol, a polyacrylate, or any combination thereof.

Statement 7: An apparatus according to any one of Statements 1-6, wherein the elastically deformable member comprises a natural or synthetic, woven or nonwoven fiber.

Statement 8: A system for plugging a well bore comprising: a plug formation apparatus positioned in a well bore, the wellbore having a first well bore length having a diameter and a second well bore length located downhole relative to the first length, wherein the second well bore length has a diameter larger than the diameter of the first well bore length, the plug formation apparatus comprising: a plug support tool having a substantially cylindrical and hollow body having one or more ports for fluid communication between an interior of the plug formation apparatus and an annulus of the well bore, a base extending radially around an outer surface of the body; and an elastically deformable member extending radially around an outer surface of the body beyond the base and supported by the base; a top-of-cement bypass sub having one or more ports, actuatable between a closed position and an open position, for fluid communication between an interior of the plug formation apparatus and an annulus of the well bore; a detachment member coupled with the top-of-cement bypass sub; and a length of tubing fluidically coupled with an upper portion of the plug support tool and a lower portion of the top-of cement bypass sub, wherein a diameter of the elastically deformable member is larger than a diameter of the second well bore length.

Statement 9: A system according to Statement 8, wherein the plug formation apparatus further comprises a second length of tubing fluidically coupled with an upper portion of the top-of cement bypass sub and a lower portion of the detachment member.

Statement 10: A system according to any one of Statements 8-9, wherein the well bore penetrates a formation containing hydrocarbons.

Statement 11: A system according to any one of Statements 8-10, wherein the well bore penetrates a formation containing a salt.

Statement 12: A system according to any one of Statements 8-11, wherein the elastically deformable member comprises a plurality of partially overlapping plates.

Statement 13: A system according to any one of Statements 8-12, wherein the plug formation apparatus further comprises one or more additional top-of cement bypass subs, the one or more additional top-of cement bypass subs coupled with the upper portion of the top-of cement bypass sub and the lower portion of the detachment member via one or more lengths of tubing.

Statement 14: A system according to any one of Statements 8-13, wherein the elastically deformable member comprises a rubber, a fluoropolymer, a polyolefin, a polyacrylonitrile, an aromatic polyamide, a nylon, a polyester, a polyester-polyurethane copolymer, a polyvinyl chloride, a polyvinyl alcohol, a polyacrylate, or any combination thereof.

Statement 15: A system according to any one of Statements 8-14, wherein the elastically deformable member comprises a natural or synthetic, woven or nonwoven fiber.

Statement 16: A system according to any one of Statements 8-15, wherein the first well bore length is cased.

Statement 17: A method of plugging a well bore comprising: traversing a well bore to a pre-determined depth with a plug formation apparatus, the plug formation apparatus comprising: a plug support tool having: a substantially cylindrical and hollow body having one or more apertures for fluid communication between an interior of the plug formation apparatus and an annulus of the well bore, a base extending radially around an outer surface of the body, an elastically deformable member extending radially around an outer surface of the body beyond the base and supported by the base, a top-of-cement bypass sub having one or more ports, actuatable between a closed position and an open position, for fluid communication between an interior of the plug formation apparatus and an annulus of the well bore, a detachment member coupled with the top-of-cement bypass sub, and a length of tubing fluidically coupled with an upper portion of the plug support tool and a lower portion of the top-of cement bypass sub; circulating a first plugging agent through the plug support tool and into an annulus of the well bore to the top-of cement bypass sub; injecting a diverter tool through the plug formation apparatus to the top-of cement bypass sub; actuating the one or more ports of the top-of cement bypass sub to the open position; circulating a second plugging agent through the top-of cement bypass sub and into the annulus of the well bore; and actuating the detachment member to uncouple from the top-of-cement bypass sub.

Statement 18: A method according to Statement 17, wherein the well bore comprises a first well bore length having a diameter, and a second well bore length located downhole relative to the first length, wherein the second well bore length has a diameter larger than the diameter of the first well bore length.

Statement 19: A method according to any one of Statements 17-18, wherein the plug formation apparatus is placed in a pre-determined location of the second well bore length.

Statement 20: A method according to any one of Statements 17-19, wherein the diameter of the elastically deformable member is 10 to 50% larger than the diameter of the second well bore length in diameter.

Statement 21: A method according to any one of Statements 17-20, further comprising performing a pull test on the plug formation apparatus after injecting the diverter tool through the portion of the plug formation apparatus to the top-of cement bypass sub.

Statement 22: A method according to any one of Statements 17-21, further comprising performing a pull test on the plug formation apparatus prior to actuating the disconnect member to uncouple with the top-of-cement bypass sub.

Statement 23: A method according to any one of Statements 17-22, wherein a load applied to the plug formation apparatus is monitored by a load measuring device.

Statement 24: A method according to any one of Statements 17-23, wherein the second plugging agent is circulated through the top-of cement bypass sub and into the annulus of the well bore until the second plugging agent reaches a distance ranging from 20 to 100 feet downhole relative to the detachment member.

Statement 25: A method of plugging a well bore comprising traversing a well bore to a pre-determined depth with a plug formation apparatus, the plug formation apparatus comprising: a plug support base and a detachment member configured to couple and decouple from a work string, wherein the work string is coupled to oil well surface equipment; circulating a first plugging agent into an annulus of the well bore to the top-of cement bypass sub, wherein first plugging agent is supported by the plug formation apparatus and the oil well surface equipment; allowing the first plugging agent to form a first hardened plug; applying a pulling force in an uphole direction on the first hardened plug; circulating a second plugging agent through the top-of cement bypass sub and into the annulus of the well bore, wherein second plugging agent is supported by the plug formation apparatus and the oil well surface equipment; and actuating the detachment member to uncouple from the top-of-cement bypass sub.

Statement 26: A method according to Statement 25 further comprising allowing the second plugging agent to form a first hardened plug; and applying a pulling force in an uphole direction on the second hardened plug.

The foregoing descriptions of specific compositions and methods of the present disclosure have been presented for purposes of illustration and description. They are not intended to be exhaustive or to limit the disclosure to the precise compositions and methods disclosed and obviously many modifications and variations are possible in light of the above teaching. The examples were chosen and described in order to best explain the principles of the disclosure and its practical application, to thereby enable others skilled in the art to best utilize the disclosure with various modifications as are suited to the particular use contemplated. It is intended that the scope of the disclosure be defined by the claims appended hereto and their equivalents.

What is claimed:

1. A plug formation apparatus comprising:

a plug support tool having:

a substantially cylindrical and hollow body having one or more ports for fluid communication between an interior passageway of the plug formation apparatus and an annulus of a well bore;

a base extending radially around an outer surface of the lower body; and an elastically deformable member extending radially around an outer surface of the body beyond the base and supported by the base;

a top-of-cement bypass sub located uphole from the plug support tool and having an internal passageway and one or more ports, the one or more ports actuatable between a closed position and an open position, wherein in the open position fluid is permitted to exit from the internal passageway;

a detachment member coupled with the top-of-cement bypass sub coupleable with a tubular string; and a length of tubing fluidically coupled with an upper portion of the plug support tool and a lower portion of the top-of cement bypass sub, a restricted passageway portion between the internal passageway of the top-of-cement bypass sub and the interior passageway of the plug support tool, the restricted passageway portion having a smaller diameter than the internal passageway of the top-of-cement bypass sub shaped to receive a dart, wherein upon seating of the dart the one or more ports actuated to the open position from the closed position.

2. The plug formation apparatus of claim 1, further comprising a second length of tubing fluidically coupled with an upper portion of the top-of cement bypass sub and a lower portion of the detachment member.

3. The plug formation apparatus of claim 1, wherein the elastically deformable member comprises a plurality of partially overlapping plates.

4. The plug formation apparatus of claim 1, wherein the detachment member is a bottom-hole kickoff assembly.

5. The plug formation apparatus of claim 1, further comprising one or more additional top-of cement bypass subs, the one or more additional top-of-cement bypass subs coupled with the upper portion of the top-of-cement bypass sub and the lower portion of the detachment member via one or more lengths of tubing.

6. The plug formation apparatus of claim 1, wherein the elastically deformable member comprises a rubber, a fluoropolymer, a polyolefm, a polyacrylonitrile, an aromatic polyamide, a nylon, a polyester, a polyester-polyurethane copolymer, a polyvinyl chloride, a polyvinyl alcohol, a polyacrylate, or any combination thereof.

7. The plug formation apparatus of claim 1, wherein the elastically deformable member comprises a natural or synthetic, woven or nonwoven fiber.

8. The plug formation apparatus of claim 1, further comprising an aperture at a tail end of the plug support tool and downhole from the one or more ports of the plug support tool.

9. The plug formation apparatus of claim 1, further comprising a restricted passageway portion uphole from the aperture and having a smaller diameter than the internal passageway top-of-cement bypass shaped to receive a dart.

10. A system for plugging a well bore comprising:

a plug formation apparatus positioned in a well bore, the wellbore having a first well bore length having a diameter and a second well bore length located downhole relative to the first length, wherein the second well bore length has a diameter larger than the diameter of the first well bore length, the plug formation apparatus comprising:

a plug support tool having:

a substantially cylindrical and hollow body having one or more ports for fluid communication between an interior passageway of the plug formation apparatus and an annulus of the well bore;

a base extending radially around an outer surface of the lower body; and an elastically deformable member extending radially around an outer surface of the body beyond the base and supported by the base, the elastically deformable member contacting a surface of the wellbore, a top-of-cement bypass sub located uphole from the plug support tool and having an internal passageway and one or more ports, the one or more ports actuatable between a closed position and an open position for fluid communication between an interior of the plug formation apparatus and an annulus of the well bore;

a detachment member coupled with the top-of-cement bypass sub coupleable with a tubular string; and a length of tubing fluidically coupled with an upper portion of the plug support tool and a lower portion of the top-of cement bypass sub, wherein a diameter of the elastically deformable member is larger than a diameter of the second well bore length, a restricted passageway portion between the internal passageway of the top-of-cement bypass sub and the interior passageway of the plug support tool, the restricted passageway portion having a smaller diameter than the internal passageway of the top-of-cement bypass sub shaped to receive a dart, wherein upon seating of the dart the one or more ports actuated to the open position from the closed position.

11. The system of claim 10, wherein the plug formation apparatus further comprises a second length of tubing fluidically coupled with an upper portion of the top-of cement bypass sub and a lower portion of the detachment member.

12. The system of claim 10, wherein the well bore penetrates a formation containing hydrocarbons.

13. The system of claim 10, wherein the well bore penetrates a formation containing a salt.

14. The system of claim 10, wherein the elastically deformable member comprises a plurality of partially overlapping plates.

15. The system of claim 10, wherein the plug formation apparatus further comprises one or more additional top-of cement bypass subs, the one or more additional top-of cement bypass subs coupled with the upper portion of the top-of cement bypass sub and the lower portion of the detachment member via one or more lengths of tubing.

16. The system of claim 10, wherein the elastically deformable member comprises a rubber, a fluoropolymer, a polyolefm, a polyacrylonitrile, an aromatic polyamide, a nylon, a polyester, a polyester-polyurethane copolymer, a polyvinyl chloride, a polyvinyl alcohol, a polyacrylate, or any combination thereof.

17. The system of claim 10, wherein the elastically deformable member comprises a natural or synthetic, woven or nonwoven fiber.

18. The system of claim 10, wherein the first well bore length is cased.

19. The method of claim 18, allowing the first plugging agent to form a first hardened plug;

applying a pulling force in an uphole direction on the first hardened plug.

20. A method of plugging a well bore comprising:

traversing a well bore to a pre-determined depth with a plug formation apparatus, the plug formation apparatus comprising:

a plug support tool having:

a substantially cylindrical and hollow body having one or more apertures for fluid communication between an interior of the plug formation apparatus and an annulus of the well bore;

a base extending radially around an outer surface of the body;

an elastically deformable member extending radially around an outer surface of the body beyond the base and supported by the base;

a top-of-cement bypass sub located uphole from the plug support tool and having an internal passageway and having one or more ports, the one or more ports actuatable between a closed position and an open position, for fluid communication between an interior of the plug formation apparatus and an annulus of the well bore, wherein in the open position fluid is permitted to exit from the internal passageway;

a detachment member coupled with the top-of-cement bypass sub coupleable with a tubular string;

a length of tubing fluidically coupled with an upper portion of the plug support tool and a lower portion of the top-of cement bypass sub; and a restricted passageway portion between the internal passageway of the top-of-cement bypass sub and the interior passageway of the plug support tool, the restricted passageway portion having a smaller diameter than the internal passageway of the top-of-cement bypass sub;

circulating a first plugging agent through the one or more ports of the plug support tool and into an annulus of the well bore to the top-of cement bypass sub, the first plugging agent resting on the elastically deformable member in the annulus;

injecting a diverter tool through the plug formation apparatus to the top-of-cement bypass sub to rest on the restricted passageway portion and block fluid flow from the top-of-cement bypass to the a plug support tool;

actuating the one or more ports of the top-of cement bypass sub to the open position;

circulating a second plugging agent through the top-of cement bypass sub and into the annulus of the well bore, the second plugging agent being uphole from the first plugging agent; and actuating the detachment member to uncouple from the top-of-cement bypass sub.

21. The method of claim 20, wherein the well bore comprises:

a first well bore length having a diameter; and a second well bore length located downhole relative to the first length, wherein the second well bore length has a diameter larger than the diameter of the first well bore length.

22. The method of claim 21, wherein the plug formation apparatus is placed in a pre-determined location of the second well bore length.

23. The method of claim 22, wherein the diameter of the elastically deformable member is 10 to 50% larger than the diameter of the second well bore length in diameter.

24. The method of claim 20, further comprising performing a pull test on the plug formation apparatus after injecting the diverter tool through the portion of the plug formation apparatus to the top-of cement bypass sub.

25. The method of claim 20, further comprising performing a pull test on the plug formation apparatus prior to actuating the detachment member to uncouple with the top-of-cement bypass sub.

26. The method of claim 20, wherein a load applied to the plug formation apparatus is monitored by a load measuring device.

27. The method of claim 20, wherein the second plugging agent is circulated through the top-of cement bypass sub and into the annulus of the well bore until the second plugging agent reaches a distance ranging from 20 to 100 feet downhole relative to the detachment member.

* * * * *